United States Patent [19]

Baber

[11] Patent Number: 4,580,820

[45] Date of Patent: Apr. 8, 1986

[54] SECURITY DEVICES

[76] Inventor: Murray J. Baber, 105 Anzac Ave., Auckland, New Zealand

[21] Appl. No.: 695,424

[22] Filed: Jan. 28, 1985

Related U.S. Application Data

[63] Continuation of Ser. No. 421,166, Sep. 22, 1982, abandoned.

[30] Foreign Application Priority Data

Oct. 15, 1981 [NZ] New Zealand ..... 198659

[51] Int. Cl.[4] ..... E05C 17/36

[52] U.S. Cl. ..... 292/264; 292/341.17

[58] Field of Search ..... 292/264, 274, 272, 341.17, 292/DIG. 16; 70/93

[56] References Cited

U.S. PATENT DOCUMENTS

| | | | |
|---|---|---|---|
| 1,988,049 | 1/1935 | Reiner | 292/264 |
| 2,062,020 | 11/1936 | Engel | 70/93 |
| 2,100,233 | 11/1937 | Beaumont | 70/93 |
| 2,440,510 | 4/1948 | Hagstrom | 292/341.17 |
| 2,454,794 | 11/1948 | Hakanson | 292/264 |
| 2,755,122 | 7/1956 | Salo | 292/264 |
| 3,657,908 | 4/1972 | Schwartz et al. | 70/93 |
| 3,897,966 | 8/1975 | Draughon | 292/264 |
| 4,027,907 | 6/1977 | Crepinsek | 292/264 |
| 4,254,975 | 3/1981 | Miller | 292/274 X |

FOREIGN PATENT DOCUMENTS

| | | | |
|---|---|---|---|
| 23421 | 9/1930 | Australia | 292/264 |
| 287647 | 6/1966 | Australia | 292/264 |
| 1260284 | 1/1972 | United Kingdom | 292/264 |
| 1516093 | 6/1978 | United Kingdom | 292/264 |
| 2111116 | 6/1983 | United Kingdom | 292/264 |

*Primary Examiner*—Alexander Grosz
*Assistant Examiner*—Russell W. Illich
*Attorney, Agent, or Firm*—Holman & Stern

[57] ABSTRACT

A lock in the form of a night latch comprising a spring, an elongated member connected to the spring, a head on the elongated member to mount the spring on a receiving device, a securing device mounted on a second receiving device with which the head can be engaged in use in a manner such that some distortion of the spring can occur with the head remaining in engagement with the securing device, but so that the head can be completely disengaged from said securing device if desired.

20 Claims, 4 Drawing Figures

SECURITY DEVICES

This is a continuation of application Ser. No. 06/421,166, filed Sept. 22, 1982, now abandoned.

BACKGROUND OF THE INVENTION

1. Field of the Invention

This invention relates to a lock and is particularly though not solely for use to provide a security chain for doors or windows, or which is usable in other circumstances.

2. Description of the Prior Art

Locks of the security chain or night latch type currently available usually comprise a member with a keyhole slot fixed to a door or door jamb into which is insertable a member fixed on a chain attached to the other of the door or door jamb. Such chains have disadvantages in that they are often cumbersome and unattractive in appearance and the strength of the construction can be suspect, the material about the keyhole slot being inclined to distort under pressure to allow the slotted member to spring from the slot. Also pressure on fixing screws can have a substantial component along the screw. Furthermore such devices present members which stand out from the door and door jamb which is undesirable. They also require an operator to insert the member into the keyhole slot.

BRIEF SUMMARY OF THE INVENTION

It is therefore an object of the present invention to provide a lock which will obviate or minimize the foregoing disadvantages in a simple yet effective manner.

Accordingly the invention consists in a lock comprising a spring, an elongated member connected with the spring, a head on the elongated member, fixing means to mount the spring on a receiving device, a housing mountable on a further receiving device, a slot in the housing having an entrance through which the head can pass so that the elongated member extends through the slot, and a closure member movable to at least partly close the entrance, so that with the closure member in a closed position some distortion of the spring can occur with the head remaining in engagement with the housing, and with said closure device moved from the closed position the head can be completely disengaged from the housing, the slot being positioned so that with the housing correctly located on the further receiving device, relative closing movement between the receiving device and further receiving device will cause the head to enter the slot.

To those skilled in the art to which this invention relates, many changes in construction and widely differing embodiments and applications of the invention will suggest themselves without departing from the scope of the invention as defined in the appended claims. The disclosures and the descriptions herein are purely illustrative and it is not our intention to limit the scope of the invention by those disclosures and descriptions, or otherwise, than by the terms of the appended claims.

BRIEF DESCRIPTION OF THE DRAWINGS

One preferred form of the invention will now be described with reference to the accompanying drawings wherein.

DETAILED DESCRIPTION

Figure 1:
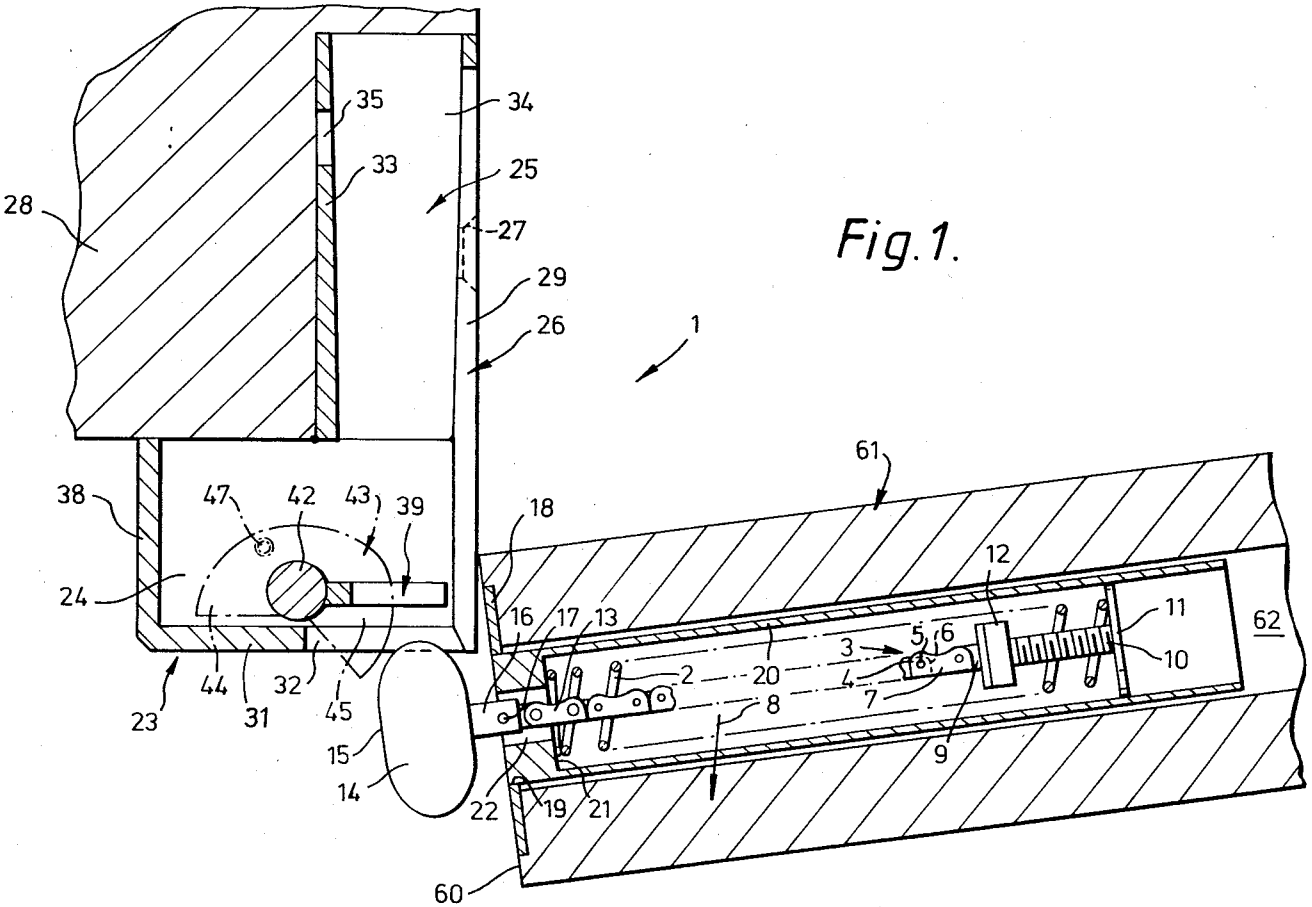
FIG. 1 is a diagrammatic cross-sectional view of a lock according to one form of the invention usable as a door security chain.
Figure 2:
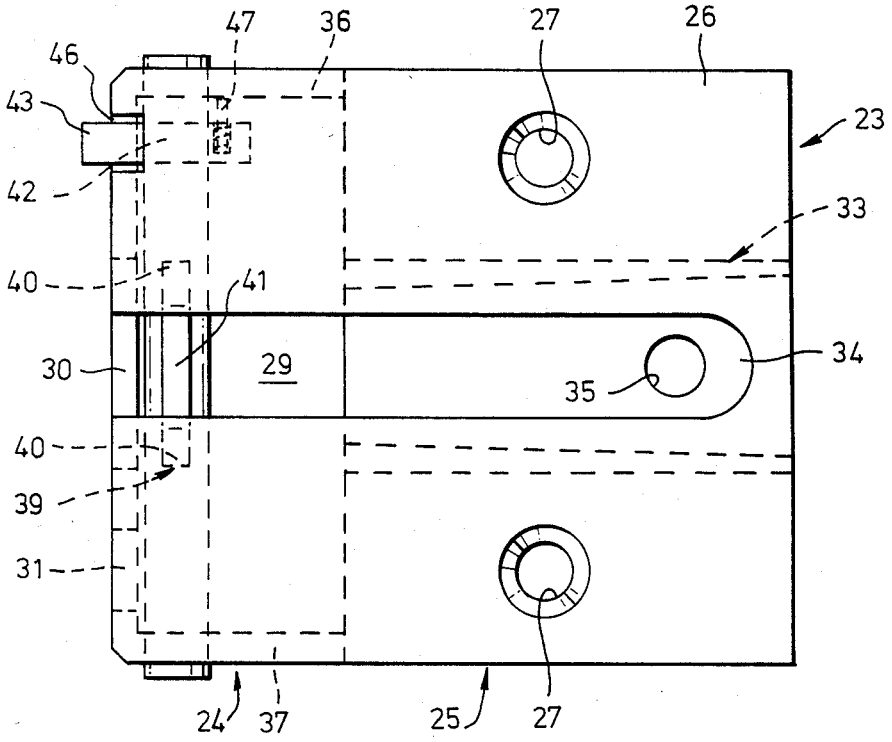
FIG. 2 is a side elevational view of an outerplate forming a securing device for use in the lock of FIG. 1.

Referring to the drawings lock 1 as

Comprises a spring 2 which is preferably a compression spring which which is engaged an elongated member, for example, chain 3. The chain is desirably a chain that can flex in only one direction to give added security when used as a security chain. A one way flexing chain will prevent in use the chain being drawn outwardly through the door in attempts to open the door. To this effect the chain 3 is formed of links each having at least a pair of cheek plates 4 spaced by pins 5. The pins 5 also engage with joining member 6 (shown in dash line in one chain joint) between links. The cheek plates 4 of adjacent links are substantially in and to end abutment as shown and are flat sided on side 7 and square ended. Thus in use the square ends, at least, substantially prevent flexing of the chain except in the direction of arrow 8. The chain 3 preferably extends axially through the compression spring 2 and is engaged therewith for example in the following manner. The chain 3 may be engaged at its base end 9 with a rod 10 to which is affixed a washer or plate 11 so that the interior end of the spring 2 abuts the washer 11. The rod 10 may be threaded and fixed thereon may be an apertured member 12 threaded on the internal surface which can be positioned on the threaded rod 10 so as to provide a stop to limit the extent to which the chain can be drawn outwardly.

The outward end 13 of the chain 3, preferably terminates in a head 14, preferably an enlarged or bulbous head which may be for example of a substantially circular shape when viewed from the front and oval or semicircular when viewed from the side. Desirably the head 14 has a flat front face 15. The head 14 may be engaged with the chain 3 for example by means of a cylindrical extension member 16 into which the chain 3 may be passed to be fixed by a securing pin 17.

Fixing means are provided to mount the spring arrangement for example in a door and the fixing means may comprise a fixing plate 18 having an aperture 19 through which the chain passes. A barrel 20 may be provided which is engaged with the fixing plate 18, for example, by being a press fit in aperture 19. The barrel 20 preferably provides a ledge 21 against which the outer end of the spring 2 abuts in use. The barrel also provides an opening 22 through which chain 3 passes in use. If the barrel is made from material such as acetyl plastic, it also provides a self lubricating guide for the chain 3 about opening 22.

A securing device is provided with which the head 14 can be engaged and this preferably comprises a housing 23. The housing 23 preferably has a front part 24 and a rear part 25 by construction which will now be described. A side plate 26 is provided, preferably including apertures 27 to enable the plate 26 to be engaged with door jamb 28 or the like by screws 30 (not shown). The plate 26 includes slot 29 having an open end 30.

A front plate 31 is also provided extending from the side plate 26 and having a front aperture 32. A channel member 33 is fixed for example by its arms 34 to the side plate 26. A screw hole 35 is also desirably provided in the base of the channel. The front part 24 also includes a top plate 36 and bottom plate 37 and an end plate 38. A gate or other closure member 39 is provided which has arms 40 separated by a gap 41. To enable the gate 39 to be moved across the opening 32 or removed therefrom a movement mechanism is provided. This may include an axle 42 passing through apertures in top plate 36 and bottom plate 37 with a suitable control member 43 positioned thereon which may be contacted by a user externally of the front part 24. The control member 43 may comprise a member in the form substantially of a sector providing wings 44 and 45 which extend through a gap 46 in front member 31. Thus by pushing a selected wing 44 or 45 the closure 39 is rotated.

Resistance to movement of the control member 43 may be gained by a friction member such as spring loaded pin 47 which bears, in use, on the underside of top member 36.

The dimensions of the construction is such that head 14 will pass through opening 32 and along channel 34 preferably only in the "side on" position shown in FIG. 1 but not in a "front on" position. The chain 2 or member 17 will pass along slot 29 and through gap 41 but so that head 14 will not pass outwardly through slot 29 or through gap 41.

Figure 3:
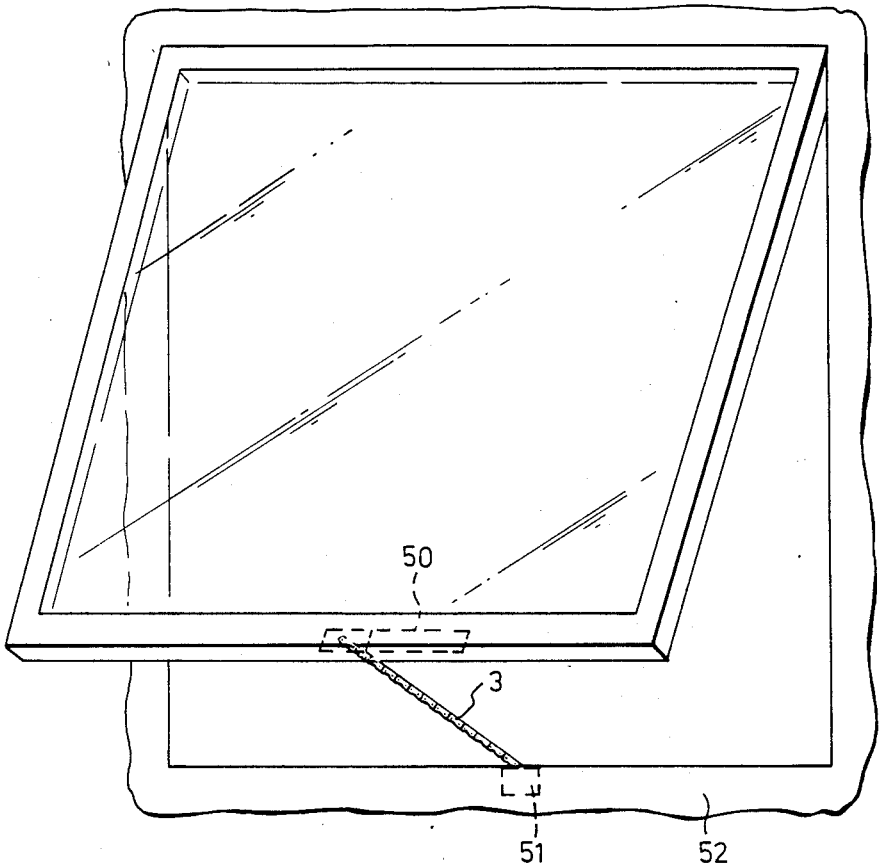
FIG. 3 is a schematic perspective view showing an alternative use of the invention.
Figure 4:
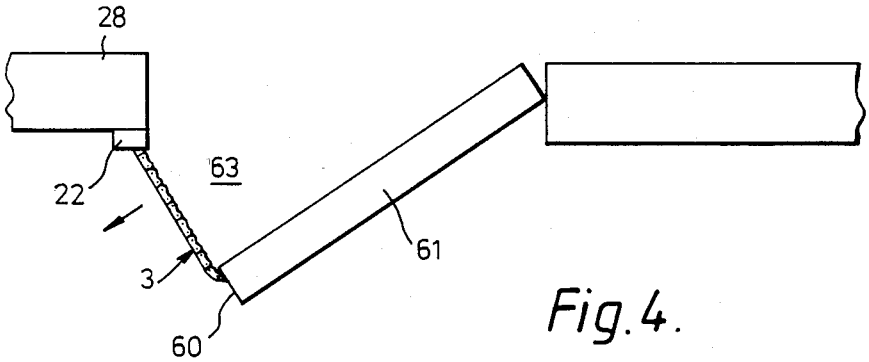
FIG. 4 is a diagrammatic plan view of the invention in use.

The construction of FIG. 3 is substantially similar except that the chain and spring are mounted within a housing 50 which may be fitted for example to the frame of a window and a housing 51 is provided with which the head 14 may be engaged for example on the window sill 52.

In use, the housing 23 is fitted on a door jamb 28 and the plate 18 is fitted to the front edge 60 of a door 61 so that spring 2 is positioned within a hole 62 formed in the door.

With the door 61 initially open the door 61 may be closed in a manner such that the head 14 will pass through the entrance 32 and so that the chain will pass along the slot 29. If the closure member 39 closes the entrance 30 then the striking of head 14 against the closure member 39 will cause the closure member 39 to rotate and so admit the head 14 to channel 33. The control 43 is then rotated so that the arms 40 are positioned adjacent the entrance 32 and so that the closure member 30 is positioned substantially across the entrance 32. The bulbous head 14 cannot now be withdrawn although it can be brought up against the closure 39 by passing the chain 3 between the bifurcated arms 40.

The door can then be opened a small distance by compression of the spring 2 for example to allow the occupant of a house to see who stands on the opposite side of the door.

To again fully open the door the bulbous head 14 must be withdrawn towards the rear of the channel 33 to allow the closure member 39 to be rotated clear of the opening 32 to allow the door 61 to be reopened.

As can be seen from FIG. 1, the head 14 must slide in the rear part 25 substantially in the disposition shown. However, when the head 14 is in the front part 24 in position against the closure member 39, the head will turn in the space of the front part 24. In these circumstances, the provision of the one-way chain in conjunction with the bifurcated arms, the positioning of the channel member 33 and the relative dimensions of the head 14 and the rear part 25 prevent the head 14 from being forced back into the channel which if effected would make it possible to move the closure to its open position.

The operation of the construction of FIG. 3 is substantially similar.

When the one way chain is provided the chain 3 cannot easily be pulled outwardly through a gap 63 between jamb 28 and door 61.

Thus it can be seen that a lock is provided in the form of a security chain or night latch which at least in the preferred form of the invention has the advantage that at least a security chain can be provided for example for a door or window which will allow a small opening of the door or window to view a person on the opposite side thereof without fully opening the door. It is an advantage of the preferred form that the construction is easily fixed in position and such that any forces exerted on the door are across, or transverse to any screws or the like fixing the fixing plate 18 to the door 61. Also in the embodiments described it is difficult to force the head 14 from the housing in which it is positioned whilst the door is partly open. The preferred construction has the advantages that the security lock is relatively strong and in use is substantially concealed in the door and door jamb, thereby presenting little obstruction and an acceptable appearance. The locking of the chain is substantially self acting and operation of the device is simple.

What is claimed is:

1. A lock comprising:

a spring;

an elongated member connected with said spring;

a head on said elongated member;

fixing means for mounting said spring on a first receiving device so that said elongated member is extendable and retractable with respect thereto;

a housing mountable on a second receiving device having front and side walls and a channel one side of which is formed by said side wall, said front wall being adjacent said fixing means when said receiving devices are juxtaposed;

a slot in said side wall of said housing;

an aperture in said front wall of said housing forming an entrance opening to said channel and slot through which said head and elongated member can pass, respectively, when said elongated member is fully retracted with said elongated member extending through said slot;

a closure member movable to at least party close said entrance opening so that with said closure member in a closed position some distortion of said spring can occur upon relative opening movement between said first and second receiving devices with said head remaining in engagement with said housing and said elongated member extending through said opening and with said closure member moved from said closed position said head and elongated member can be completely disengaged from said housing, said slot and channel being positioned so that with said housing correctly located on said second receiving device, relative closing and opening movement between said first receiving device and said second receiving device will cause said head to enter and exit said channel respectively.

2. A lock as claimed in claim 1 wherein said closure member comprises a bifurcated member rotatable across said opening so that said bifurcated arms are positioned adjacent said slot, the distance between said bifurcated arms being smaller than the outer dimensions of said head.

3. A lock as claimed in claim 2 wherein:
said spring comprises a compression spring;
said fixing means comprises an apertured fixing plate;
said head comprises an enlarged head; and
said elongated member comprises a chain passing axially through said spring and though the aperture in said plate having links shaped to allow flexing of the chain substantially in one direction only.

4. A lock as claimed in claim 1 wherein said closure member is rotatable about an axis substantially perpendicular to the axis of said slot.

5. A lock as claimed in claim 1 wherein said spring comprises a compression spring and said elongated member extends axially through said spring.

6. A lock as claimed in claim 1 wherein said fixing means comprises an apertured fixing plate, said elongated member passing through the aperture in said plate.

7. A lock as claimed in claim 1 wherein said head comprises an enlarged head.

8. A lock as claimed in claim 1 wherein said elongated member comprises a chain.

9. A lock as claimed in claim 8 wherein the links of said chain are shaped to allow flexing of said chain substantially only in one direction.

10. A lock comprising:
a spring;
an elongated member connected with said spring;
a head on said elongated member;
fixing means to mount said spring on a first receiving device;
a housing mountable on a second receiving device;
a slot in said housing;
said slot having an entrance opening through which said head can pass so that said elongated member extends through said slot; and
a closure member comprising a bifurcated member having arms rotatably movable across said entrance opening to a position adjacent said slot to at least partly close said entrance opening, the distance between said arms being smaller than the diameter of said head, so that with said closure member in a closed position some distortion of said spring can occur with said head remaining in engagement with said housing, but with said closure member moved from said closed position said head can be completely disengaged from said housing, said slot being positioned so that with said housing correctly located on said second receiving device, relative closing movement between said first receiving device and said second receiving device will cause said head to enter said slot.

11. A lock as claimed in claim 10 wherein said spring comprises a compression spring and said elongated member extends axially through said spring.

12. A lock as claimed in claim 10 wherein:
said spring comprises a compression spring;
said fixing means comprises an apertured fixing plate;
said head comprises an enlarged head; and
said elongated member comprises a chain passing axially through said spring and through the aperture in said plate having links shaped to allow flexing of the chain substantially in one direction only.

13. A lock comprising:
a spring;
an elongated member connected with said spring;
a head on said elongated member;
fixing means to mount said spring on a first receiving device;
a housing mountable on a second receiving device;
a slot in said housing;
said slot having an entrance through which said head can pass so that said elongated member extends through said slot; and
a closure member rotatably movable about an axis substantially perpendicular to the axis of said slot to at least partly close said entrance so that with said closure member in a closed position some distortion of said spring can occur with said head remaining in engagement with said housing, but with said closure member moved from said closed position said head can be completely disengaged from said housing, said slot being positioned so that with said housing correctly located on said second receiving device, relative closing movement between said first receiving device and said second receiving device will cause said head to enter said slot.

14. A lock as claimed in claim 13 wherein said spring comprises a compression spring and said elongated member extends axially through said spring.

15. A lock comprising:
a spring;
an elongated member connected with said spring;
a head on said elongated member;
fixing means for mounting said spring on a first receiver device so that said elongated member is extendable and retractable with respect thereto;
a housing mountable on a second receiving device, said housing having front and side walls with said front wall being adjacent said fixing means when said receiving devices are juxtaposed;
a slot in said side wall of said housing;
an aperture in said front wall of said housing forming an entrance opening through which said head and elongated member can pass, respectively; when said elongated member is fully retracted;
a closure member movable to at least partly close said aperture so that in use with said closure member in an open position a relative closing movement between said receiving devices alone will cause said head to become positioned in said housing with said elongated member extending through said slot and so that with said closure member in a closed position, and said head within said housing, some flexing of said spring can occur on relative opening movement between said first receiving device and said second receiving device with said head remaining in engagement with said housing and said elongated member extending through said aperture, and with said closure member moved from said closed position said head and elongated member can be completely disengaged from said housing by relative opening movement between said receiving devices alone.

16. A lock as claimed in claim 15 wherein said closure member comprises a bifurcated member movable across said opening so that said bifurcated arms are positioned adjacent said slot, the distance between said bifurcated arms being smaller than the outer dimensions of said head.

17. A lock as claimed in claim 16 wherein said closure member is rotatable about an axis substantially perpendicular to the axis of said slot.

18. A lock as claimed in claim 15 wherein said spring comprises a compression spring and said elongated member extends axially through said spring.

19. A lock as claimed in claim 15 wherein said fixing means comprises an apertured fixing plate and said elongated member passes through the aperture in said plate.

20. A lock as claimed in claim 15 wherein said elongated member comprises a chain.

* * * * *